US007127036B2

(12) United States Patent
Harding et al.

(10) Patent No.: US 7,127,036 B2
(45) Date of Patent: Oct. 24, 2006

(54) DEVICE FOR GENERATING X-RAYS HAVING A LIQUID METAL ANODE

(75) Inventors: Geoffrey Harding, Hamburg (DE); Volker Doormann, Hamburg (DE); Bernd David, Huettblek (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 161 days.

(21) Appl. No.: 10/506,376

(22) PCT Filed: Feb. 19, 2003

(86) PCT No.: PCT/IB03/00681

§ 371 (c)(1),
(2), (4) Date: Sep. 2, 2004

(87) PCT Pub. No.: WO03/077276

PCT Pub. Date: Sep. 18, 2003

(65) Prior Publication Data

US 2005/0105689 A1 May 19, 2005

(30) Foreign Application Priority Data

Mar. 8, 2002 (EP) ..... 02075913

(51) Int. Cl.
*H01J 35/02* (2006.01)

(52) U.S. Cl. ..... 378/139; 378/119; 378/143

(58) Field of Classification Search ..... 378/118, 378/119, 121, 127, 139, 140, 141, 143
See application file for complete search history.

(56) References Cited

U.S. PATENT DOCUMENTS 6,185,277 B1 2/2001 Harding ..... 378/143
6,961,408 B1 * 11/2005 Harding et al. ..... 378/143

* cited by examiner

*Primary Examiner*—Courtney Thomas
*Assistant Examiner*—Jurie Yun

(57) ABSTRACT

A device for generating X-rays having a source for emitting electrons accommodated in a vacuum space, a liquid metal for emitting X-rays as a result of the incidence of electrons, and a pump for causing a flow of the liquid metal through a constriction where the electrons emitted by the source impinge upon the liquid metal, the constriction having a cross-sectional area which, seen in a flow direction, increases so that during operation in the flow direction, a decrease of a flow velocity takes place such that a decrease of a pressure of the liquid metal in the constriction, caused by viscous flow losses, substantially corresponds with an increase of the pressure caused by the decrease of the velocity so that a uniform and relatively low mechanical load is exerted on a window separating the constriction from the vacuum space during operation.

4 Claims, 2 Drawing Sheets

DEVICE FOR GENERATING X-RAYS HAVING A LIQUID METAL ANODE

Figure 1:
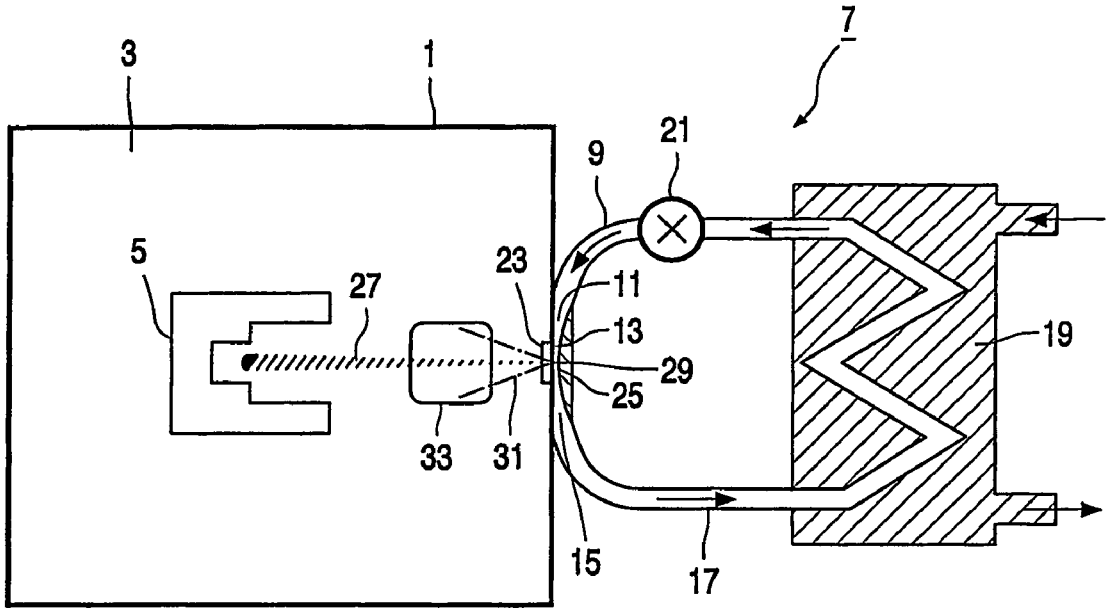

The invention relates to a device for generating X-rays, which device comprises a source for emitting electrons accommodated in a vacuum space, a liquid metal for emitting X-rays as a result of the incidence of electrons, and a pumping means for causing a flow of the liquid metal through a constriction where the electrons emitted by the source impinge upon the liquid metal, said constriction being bounded by a window, which is transparent to electrons and X-rays and separates the constriction from the vacuum space.

A device for generating X-rays of the kind mentioned in the opening paragraph is known from U.S. Pat. No. 6,185,277-B1. The window of the known device is relatively thin and is made from a material which is transparent to electrons and X-rays, e.g. diamond or molybdenum. The window prevents the vacuum space from being contaminated by the liquid metal. During operation of the known device, the liquid metal, e.g. mercury, flows through the constriction, which forms part of a closed channel system. The source generates an electron beam, which passes through the window and impinges upon the liquid metal in an impingement position in the constriction. The X-rays, emitted by the liquid metal as a result of the incidence of the electron beam, emanate through the window and through an X-ray exit window, which is provided in a housing enclosing the vacuum space. The velocity of the flow of the liquid metal in the constriction is relatively high, so that said flow is turbulent. As a result the heat, which is generated in the impingement position as a result of the incidence of the electron beam upon the liquid metal, is transported away from the impingement position by the flow of the liquid metal in an effective manner. As a result, an increase of the temperature of the liquid metal in the impingement position is limited, and a relatively high energy level of the electron beam is allowed without causing excessive heating of the liquid metal. The closed channel system of the known device further comprises a heat exchanger by means of which the liquid metal is cooled down.

During operation of the known device, a relatively high pressure is generated by the pumping means in a portion of the channel system upstream from the constriction in order to achieve a sufficiently high velocity of the liquid metal in the constriction. As a result of said high velocity and the so-called Bernoulli effect, the liquid metal in the constriction has a pressure which is low relative to the pressure generated upstream from the constriction. A problem of the known device is that, although the pressure of the liquid metal in the constriction is relatively low, deformations and even breakage of the window occur as a result of said pressure because the window is relatively thin.

It is an object of the invention to provide a device for generating X-rays of the kind mentioned in the opening paragraph, in which the pressure of the liquid metal in the constriction is further limited, so that deformations of the relatively thin window as a result of said pressure are limited and breakage of the window is prevented.

In order to achieve said object, a device for generating X-rays according to the invention is characterized in that the constriction has a cross-sectional area which, seen in a flow direction, increases in such a manner that during operation in said direction, a decrease of a flow velocity takes place such that a decrease of a pressure of the liquid metal in the constriction, caused by viscous flow losses, substantially corresponds with an increase of said pressure caused by said decrease of the velocity.

The invention is based on the recognition that the above mentioned problem of the known device is mainly caused by local pressures of the liquid metal in the constriction which are considerably higher than a main pressure level in the constriction. The invention is also based on the insight that the local pressure of the liquid metal in the constriction is determined both by the viscous flow losses of the flow of the liquid metal in the constriction and by the velocity of the flow of the liquid metal in the constriction. If said velocity were constant, seen in the direction of the flow, which would be the case if the constriction had a constant cross-sectional area in the direction of the flow, said pressure would decrease in the direction of the flow as a result of said viscous flow losses. As a result, a relatively high pressure would be necessary at the entrance of the constriction in order to achieve a certain minimal pressure at the end of the constriction, said minimal pressure being necessary to avoid flow irregularities, such as boundary-layer separations or evaporation, at the end of the constriction. Said high pressure at the entrance of the constriction and the accompanying pressure gradient between the entrance and the end of the constriction would cause a high mechanical load on the window, as a result of which the deformation and the risk of breakage of the window would strongly increase. However, in the device according to the invention the cross-sectional area increases in the direction of the flow and as a result the velocity of the flow decreases in said direction. As a result of said decrease of the velocity, the pressure of the liquid metal would increase in the direction of the flow as a result of the Bernoulli effect if the viscous flow losses were zero. In the device according to the invention, said increase of the cross-sectional area in the direction of the flow is such that the above mentioned decrease of the pressure, caused by the flow losses, is substantially compensated by the above mentioned increase of the pressure caused by the Bernoulli effect. As a result, the pressure of the liquid metal in the constriction is substantially constant throughout the constriction and, as a result, said pressure can be maintained at a relatively low level throughout the constriction by a suitable flow rate and pressure of the liquid metal upstream from the constriction. As a result, a uniform relatively low mechanical load on the window is achieved, so that deformations of the window are considerably limited and breakage of the window is prevented.

A particular embodiment of a device for generating X-rays according to the invention is characterized in that opposite to the window the constriction is bounded by a wall which tapers relative to the window, seen in an upstream direction opposite to the flow direction. In this embodiment, the increase of the cross-sectional area of the constriction in the direction of the flow is achieved as a result of the fact that a height of the constriction, i.e. a distance between the window and the wall opposite to the window, increases in said direction. Thus, the constriction can be provided with a relatively large constant width, i.e. a relatively large dimension perpendicular to the direction of the flow and perpendicular to the height. In this manner, the device is suitable for generating X-rays having a line focus extending in a direction parallel to the width of the constriction, wherein the electrons impinge upon the liquid metal in an impingement line extending parallel to the width of the constriction.

A further embodiment of a device for generating X-rays according to the invention is characterized in that said wall is deformable by means of at least one actuator, the device comprising at least one pressure sensor for measuring the pressure of the liquid metal in the constriction and a control member for controlling the actuator as a function of a pressure measured by means of the sensor. In this embodiment, the actuator is for example controlled in such a manner that the wall opposite to the window is given a profile and the constriction is given a cross-sectional area such that the pressure measured by the sensor is maintained at a value corresponding with a predetermined intended pressure, or that the measured pressure does not exceed a predetermined safety value. Preferably, a plurality a sensors is used, so that the pressure can be measured in a plurality of locations in the constriction, and a plurality of actuators is used, so that the profile of the wall opposite to the window can be adjusted in each location where the pressure is measured. In this manner, the intended uniform low pressure of the liquid metal throughout the constriction can be achieved in an accurate manner.

A yet further embodiment of a device for generating X-rays according to the invention is characterized in that said actuator is a piezo-electric actuator. The piezo-electric actuator is suitable for generating relatively small and accurate deformations of the wall opposite to the window, so that the cross-sectional area of the constriction can be adjusted very accurately. In addition, the piezo-electric actuator can also be used as a pressure sensor, so that the structure of the device is considerably simplified.

Figure 2:
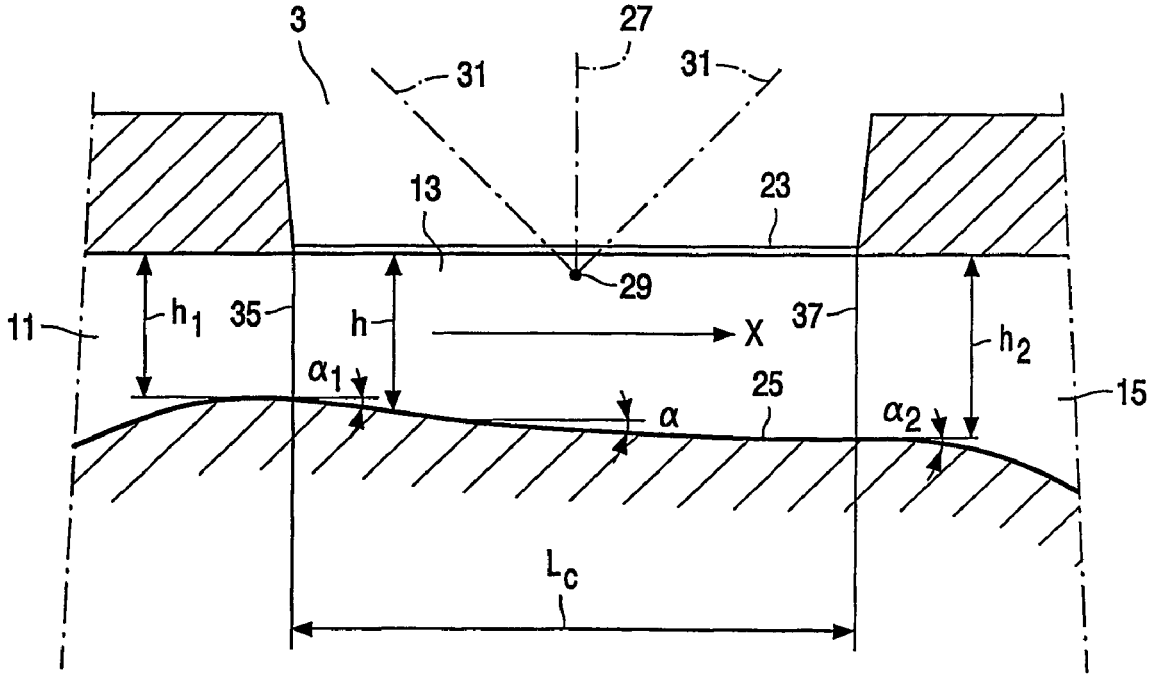
Figure 3:
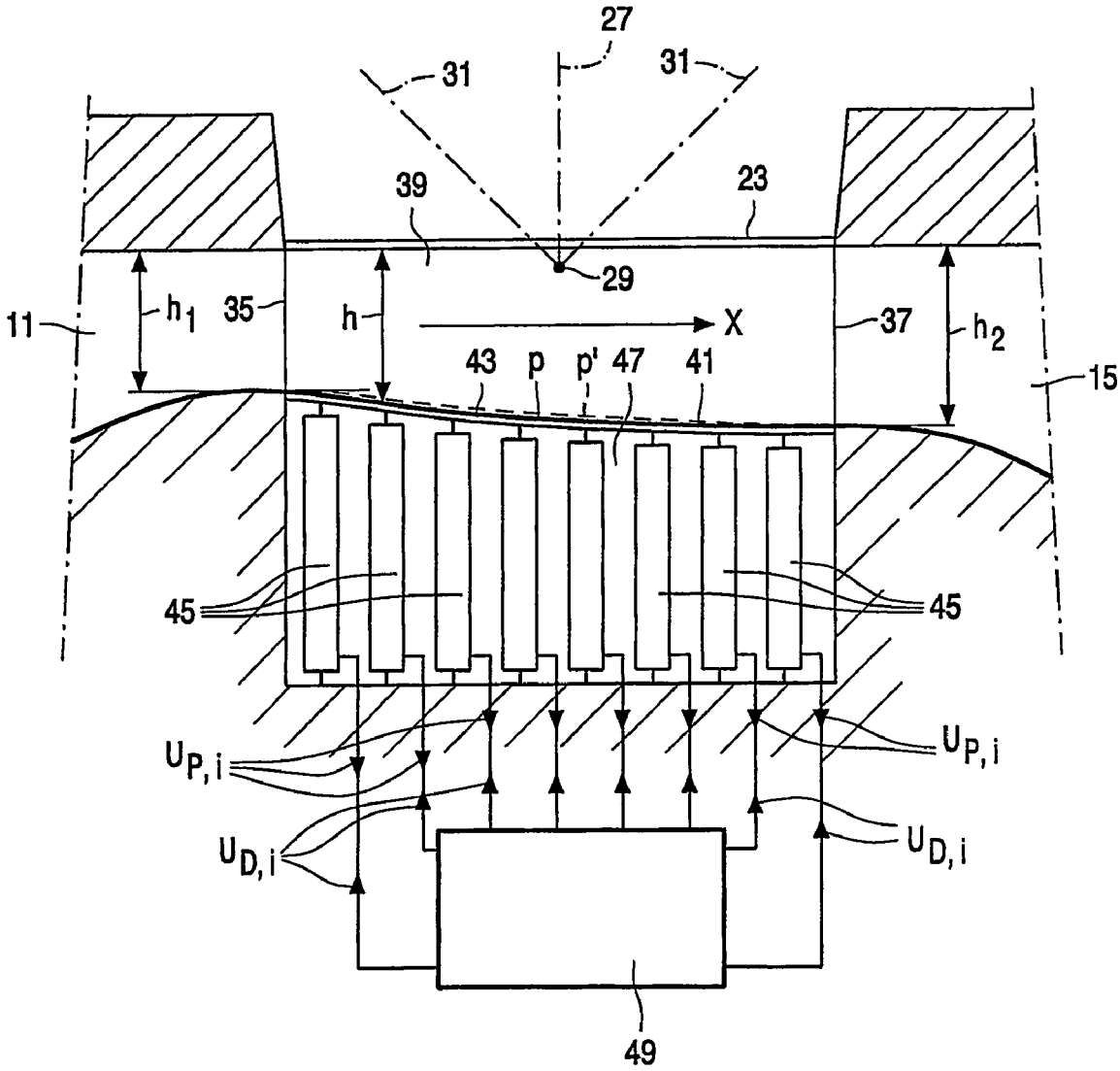

In the following, embodiments of a device for generating X-rays according to the invention will be explained further in detail with reference to the Figures, in which FIG. 1 schematically shows a first embodiment of a device for generating X-rays according to the invention, FIG. 2 shows a constriction of the device of FIG. 1, FIG. 3 shows a constriction of a second embodiment of a device for generating X-rays according to the invention, In FIG. 1 only the main components of the first embodiment of a device for generating X-rays according to the invention are schematically shown. The device comprises a housing 1 which encloses a vacuum space 3 in which a source 5 or cathode for emitting electrons is accommodated. The device further comprises a closed channel system 7 comprising an inlet channel 9, a converging part 11, a constriction 13, a diverging part 15, an outlet channel 17, a heat exchanger 19, and a hydraulic pump 21. The channel system 7 is filled with a liquid metal which has the property of emitting X-rays as a result of the incidence of electrons. In the embodiment shown, the liquid metal is an alloy of Ga, In, and Sn, but also other kinds of metals or metal alloys which are liquid at room temperature, such as for example Hg, may be used. The constriction 13 is bounded by a window 23, which is transparent to electrons and X-rays, and by a wall 25 opposite to the window 23. In the embodiment shown, the window 23 comprises a relatively thin diamond plate, but also other kinds of materials which are sufficiently transparent to electrons and X-rays, such as for example Mo, may be used. The window 23 separates the constriction 13 from the vacuum space 3, thereby preventing the vacuum space 3 from being contaminated by particles of the liquid metal.

During operation of the device, the liquid metal is caused to flow through the constriction 13 by means of the hydraulic pump 21. In the embodiment shown, the hydraulic pump 21 is of a conventional type, but also another suitable pumping means may be used instead, such as for example a magneto-hydrodynamic pump. The constriction 13 has a relatively small cross-sectional area, so that the flow of the liquid metal in the constriction 13 has a relatively high velocity and is turbulent. The source 5 generates an electron beam 27, which passes through the window 23 and impinges upon the liquid metal in an impingement position 29 in the constriction 13. As a result of the incidence of the electron beam 27 upon the liquid metal, X-rays 31 are generated in the impingement position 29. Thus, the liquid metal in the constriction 13 constitutes an anode of the device for generating X-rays. The X-rays 31 emanate through the window 23 and through an X-ray exit window 33, which is provided in the housing 1.

A further result of the incidence of the electron beam 27 upon the liquid metal is the generation of a large amount of heat in the impingement position 29. This heat is transported away from the impingement position 29 in an effective manner by the flow of the liquid metal in the constriction 13, and the heated liquid metal is subsequently cooled down again in the heat exchanger 19. In this manner, excessive heating of the liquid metal in the impingement position 29 and of the surroundings of the constriction 13 is prevented. By means of the flow of the liquid metal in the constriction 13, a relatively high rate of heat transport away from the impingement position 29 is achieved, so that a relatively high energy level of the electron beam 27 and consequently a relatively high energy level of the X-rays 31 is allowed.

As shown in FIG. 2, the constriction 13 of the first embodiment of the device according to the invention has a length $L_C$, seen in a main flow direction X, of approximately 3 mm, a height, i.e. a distance between the window 23 and the wall 25, of approximately 200 μm, and a width, seen in a direction perpendicular to the main flow direction X and perpendicular to the height, of approximately 10 mm. The relatively large width of the constriction 13 is used to generate X-rays 31 which have a line focus extending in a direction parallel to the width of the constriction 13, i.e. in a direction perpendicular to the plane of the drawing of FIG. 2. Accordingly, the impingement position 29 is an impingement line which also extends in a direction parallel to the width of the constriction 13. In order to obtain a sufficiently high velocity of the liquid metal in the constriction 13 during operation, the pump 21 generates a relatively high pressure of the liquid metal in the inlet channel 9 upstream from the constriction 13. In the embodiment shown, a pressure in the order of 50–60 bar is generated in the inlet channel 9 to obtain a flow velocity in the order of 50 m/s in the constriction 13. As a result of the Bernoulli effect in the converging part 11, the pressure in the constriction 13 is in the order of 1 bar. As a result of the Bernoulli effect in the diverging part 15, the pressure in the outlet channel 17 is in the order of 40–45 bar, which is lower than the pressure in the inlet channel 11 as a result of viscous flow losses.

The liquid metal in the constriction 13 has a local pressure which is determined both by viscous flow losses of the flow of the liquid metal in the constriction 13 and by the local main velocity of the flow of the liquid metal in the constriction 13. If said local main velocity was constant in the main flow direction X, i.e. if the constriction 13 had a constant cross-sectional area in the main flow direction X, said local pressure would decrease in the main flow direction X as a result of said viscous flow losses. If said viscous flow losses were zero and said local main velocity increased or decreased in the main flow direction X as a result of, respectively, a decrease or an increase of the cross-sectional area in the main flow direction X, said local pressure would, respectively, decrease or increase as a result of the Bernoulli effect. As shown in FIG. 2, the wall 25 opposite to the window 23 tapers relative to the window 23, seen in an upstream direction opposite to the main flow direction X. As a result, the height of the constriction 13 and the cross-sectional area of the constriction 13 gradually increase in the main flow direction X, and the local main velocity of the flow of the liquid metal in the constriction 13 gradually decreases in the main flow direction X. Said increase of the cross-sectional area and the accompanying decrease of the local main velocity of the flow are such that the decrease of the local pressure of the liquid metal in the constriction 13, caused by the viscous flow losses, substantially corresponds with and, as a result, is substantially compensated by the increase of said local pressure caused by the decrease of the main local velocity and the Bernoulli effect. As a result, the pressure of the liquid metal in the constriction 13 is substantially constant throughout the constriction 13. Said pressure is maintained at a relatively low level, for example 1 bar or lower, throughout the constriction 13 by a suitable flow rate and pressure of the liquid metal in the inlet channel 9 upstream from the constriction 13. However, said level of the pressure is maintained above a certain minimal level, for example above 0,3–0,5 bar, in order to avoid flow irregularities in the constriction 13 such as boundary-layer separations or evaporation of the liquid metal. As a result of the uniform and low level of the pressure of the liquid metal in the constriction 13, a uniform and relatively low mechanical load on the window 23 is achieved, so that during operation deformations of the window 23 are considerably limited and breakage of the window is prevented.

The cross-sectional area of the constriction 13 and the accompanying profile of the wall 25 necessary to achieve the above mentioned uniform pressure of the liquid metal can be determined by means of a numerical calculation of the flow of the liquid metal in the constriction 13 or by means of experiments. In the first embodiment of the device as shown in FIGS. 1 and 2, the constriction 13 has a height $h_1$ at the location of its entrance 35 of approximately 200 μm and a height $h_2$ at the location of its end 37 of approximately 220 μm. Between the entrance 35 and the end 37 of the constriction 13 the height h of the constriction 13 gradually increases from 200 μm to 220 μm. An angle of inclination $\alpha$ of the wall 25 gradually decreases from a maximal value $\alpha_1$ at the location of the entrance 35 to a minimal value $\alpha_2$ at the location of the end 37, which is due to the fact that the decrease of the pressure per unit of length, caused by the viscous flow losses, is proportional to the square of the local flow velocity and, therefore, decreases in the main flow direction X.

As described before, in the first embodiment of the device shown in FIGS. 1 and 2 the necessary increase of the cross-sectional area of the constriction 13 in the main flow direction X is achieved as a result of the fact that the height h of the constriction 13 increases in said direction. In this embodiment, the width of the constriction 13 is constant in the main flow direction X. It is noted that the invention also covers embodiments in which the necessary increase of the cross-sectional area of the constriction in the flow direction is achieved in another way, for example by means of a constant height of the constriction and an increasing width of the constriction, or by both an increasing height and an increasing width of the constriction.

FIG. 3 shows a constriction 39 of a second embodiment of a device for generating X-rays according to the invention. Parts of the second embodiment, which correspond with parts of the first embodiment as shown in FIGS. 1 and 2, are indicated by means of corresponding reference numbers. Apart from the constriction 39, the second embodiment substantially corresponds with the first embodiment, and therefore the other parts of the second embodiment are not shown in FIG. 3 and will not be discussed. The constriction 39 is bounded by a wall 41 opposite to the window 23, which does not have a fixed profile as opposed to the wall 25 in the first embodiment described before. The wall 41 is a surface of a relatively thin metal plate 43 with, in the embodiment shown, a thickness of 200 μm. The plate 43 and accordingly also the wall 41 are deformable in a direction transverse to the main flow direction X by means of a number of piezo-electric actuators 45, which are accommodated in a closed chamber 47 below the plate 43. In an undeformed state, the wall 41 has a profile p which roughly corresponds with the profile of the wall 25 in the first embodiment shown in FIG. 2. Thus, like the constriction 13 in the first embodiment, the constriction 39 has a cross-sectional area the increase of which, seen in the main flow direction X, is such that it causes a decrease in the main flow direction X of the flow velocity such that the decrease of the pressure of the liquid metal in the constriction 39, caused by the viscous flow losses, roughly corresponds with, and hence is roughly compensated by, the increase of the pressure in the main flow direction X caused by the Bernoulli effect resulting from said decrease of the flow velocity.

The second embodiment further comprises a control member 49 which controls the actuators 45 as a function of a pressure of the liquid metal in the constriction 39 measured by means of a pressure sensor. In the embodiment shown, the piezo-electric actuators 45 are also used as pressure sensors, the actuators 45 periodically supplying electrical signals $u_{P,i}$ corresponding with a pressure exerted on the actuators 45 to the control member 49, and the control member 49 periodically supplying electrical signals $u_{D,i}$ corresponding with a deformation of the actuators 45 determined by the control member 49 in response to the signals $u_{P,i}$. The signals $u_{D,i}$ are determined by the control member 49 to be such, and accordingly the wall 41 is deformed to have such a profile p', that the pressure of the liquid metal in the constriction 39, measured by each of the actuators 45, corresponds with a predetermined constant value below 1 bar. Thus, it is achieved that the pressure of the liquid metal in the constriction 39 is maintained at said predetermined value in a very accurate manner, particularly in case of deviations of the pressure and of the velocity of the liquid metal in the converging part 11. The piezo-electric actuators 45 are suitable for generating relatively small and accurate deformations of the wall 41, so that the profile p' of the wall 41 can be adjusted very accurately. In addition, the structure of the device is relatively simple in that the actuators 45 also constitute the necessary pressure sensors. It is however noted that the invention also comprises embodiments in which separate pressure sensors are used to measure the pressure of the liquid metal in the constriction 39, and/or in which another type of actuator is used. The invention also comprises embodiments in which the structure of the device is further simplified in that fewer actuators and pressure sensors are used.

The invention claimed is:

1. A device for generating X-rays comprising:

a source for emitting electrons accommodated in a vacuum space;

a liquid metal for emitting X-rays as a result of the incidence of electrons;

a pumping means for causing a flow of the liquid metal through a constriction where the electrons emitted by the source impinge upon the liquid metal;

a window for bounding the constriction at least in part, the window being transparent to at least electrons and X-rays and serving to separate the constriction from the vacuum space; and a wall for bounding the constriction at least in part, the wall being at least substantially opposite to the window and having a taper associated therewith, wherein the constriction has a cross-sectional area relative to a flow direction that increases so that during operation in the flow direction, a decrease of a flow velocity causes a decrease of a pressure of the liquid metal in the constriction substantially corresponding to an increase of the pressure resulting from the decrease of the velocity.

2. The device of claim 1, wherein the taper associated with the wall tapers relative to the window, seen in an upstream direction opposite to the flow direction.

3. The device of claim 1, wherein the wall is deformable by means of at least one actuator, the device having at least one pressure sensor for measuring the pressure of the liquid metal in the constriction and a control member for controlling the actuator as a function of a pressure measured by means of the sensor.

4. A device as claimed in claim 3, wherein the actuator is a piezo-electric actuator.

* * * * *